United States Patent [19]

Lindströ

[11] Patent Number: 5,076,253

[45] Date of Patent: Dec. 31, 1991

[54] BURNER FOR WOOD LOGS

[76] Inventor: Olle B. Lindströ, Per Sundbergs v 26, S-18363 Täby, Sweden

[21] Appl. No.: 476,365

[22] PCT Filed: Dec. 7, 1988

[86] PCT No.: PCT/SE88/00666

§ 371 Date: May 15, 1990

§ 102(e) Date: May 15, 1990

[87] PCT Pub. No.: WO89/05424

PCT Pub. Date: Jun. 15, 1989

[51] Int. Cl.[5] ..... F24B 1/193; F23H 13/02

[52] U.S. Cl. ..... 126/540; 126/152 B; 126/298

[58] Field of Search ..... 126/540, 544, 225, 224, 126/154, 298, 58, 59, 59.5, 66, 65, 505, 541, 152 R, 152 B

[56] References Cited

U.S. PATENT DOCUMENTS

| | | | |
|---|---|---|---|
| 254,375 | 2/1882 | Reeves | 126/152 R |
| 658,295 | 9/1900 | Sullivan | 126/298 |
| 704,359 | 7/1902 | McGurrin | 126/224 |
| 835,137 | 11/1906 | Lautenschlager | 126/59.5 |
| 4,131,180 | 12/1978 | Bauder | 126/298 |
| 4,180,054 | 12/1979 | Romero et al. | 126/540 |
| 4,280,475 | 7/1981 | Truran | 126/152 B X |
| 4,299,197 | 11/1981 | Turley | 126/541 |
| 4,651,708 | 3/1987 | Groeneweg | 126/59 Y |

FOREIGN PATENT DOCUMENTS

| | | |
|---|---|---|
| 1215283 | 12/1986 | Canada . |
| 2589993 | 5/1987 | France . |
| 397287 | 8/1933 | United Kingdom . |

*Primary Examiner*—Larry Jones

[57] ABSTRACT

The burner is intended for combustion of wood logs or other similar solid fuels. The burner which will be called the basket burner is shaped as an open inclined basket (1) comprising a bottom plate (3) and a backing plate (4) which are inclined towards the horizontal plane, respectively the vertical plane, so that the connection between the bottom plate and the backing plate constitutes the lowest part of the basket. The backing plate forms a chute or hold for the package of wood logs. The two plates contain holes (8) for air. The fuel is piled up against the backing plate and is supported by the bottom plate so as to form a compact bundle or parallel wood logs with minimized surface/volume ratio. The design of the basket burner makes the wood logs serve as efficient supporting burners for each other. Thanks to the shape of the basket burner the burning wood logs are successively brought towards each other and towards the lowest part of the basket burner during the combustion. At the end of the combustion there remains an upright layer of burning char which radiates heat towards the space in front of the fireplace which facilitates rapid lighting of a new charge of wood.

6 Claims, 1 Drawing Sheet

BURNER FOR WOOD LOGS

BACKGROUND

1. Field of Invention

Wood burning has been a practice since the old ages but is still a primitive process, which can be improved with respect to the completeness of the combustion and the emissions. The difficulties are caused by the small size of the fireplace, the individuality of the wood logs and the charge procedure with intermittent feed of new fuel from time to time. Many inventors have worked with these problems and have reported solutions, which are said to be a satisfactory answer to these problems. Nobody has, however, yet presented a universal solution which can handle all different situations in the practice with different fuels, different routines for combustion etc. Several cooperating technical measures are required to achieve this goal.

2. Description of Related Art

It is thus necessary to rely on several means for efficient and environmentally acceptable combustion of wood logs considering the variations with respect to the activity, moisture content, surface/volume ratio, etc in a collection of wood logs. The present invention is concerned with a new burner for wood which gives a very good combustion result during the different conditions of the practice in spite of a very simple mechanical design.

The burner, which will be called the basket burner in the following, can be put up in an open fireplace but it can also be built in as an integrated part of wood stoves of different kinds, inserts, tile-stoves, etc. The burner is also suitable for combustion of thicker wood logs, bundles of thin wood logs etc.

A primary purpose with the invention is to produce a useful configuration of the charge of wood logs for good process technical conditions with respect to the interaction between the wood logs in the fuel charge, the combustion air and the combustion gases. This will give a very efficient combustion process with small emissions of harmful hydrocarbons and carbon monoxide.

A second purpose is to produce conditions for a very complete combustion of the fuel wood with a small residue of unburnt material.

A third purpose is to produce conditions for a convenient and fast lighting of the wood charge with small emissions also during this part of the operation, which is critical from an emission point of view.

A fourth purpose is to reduce emissions when a new charge of wood logs is put on the fire.

The burner according to the invention meets the above desiderata in a very efficient and surprisingly simple way. The invention is a result of a new insight into the problems which arise during combustion of wood.

There is a very complicated interplay between the wood logs in a burning fire. This interplay contains both positive and negative effects. The successive lighting up when an already burning and glowing log of wood puts fire to adjacent wood logs is a well known example of positive interplay. Negative effects are shielding from air supply or that there will be no fire only smoke, e.g. caused by the pyrolysis gas pushing away the combustion air.

The supporting interplay between the wood logs in a burning fire is diminished towards the end of firing. The ash layer contains then unburnt charred ends of the wood logs. A few charred wood logs remain standing up against the wall of the fireplace as a monument over unsatisfactory combustion technology.

The different wood logs in a burning fire thus serve as a kind of support burners for each other. These circumstances have not been taken sufficiently seriously earlier.

The combustion chamber, the means for supply of primary and secondary combustion air and the grate are frequently designed without due consideration to the conditions which have been touched upon above. The wood is frequently put directly on a plane grate, see e.g. the description of modern wood combustion techniques for so-called "clean burners" in "Wood'n Energy", December 1984, pp 14–18.

The combustion result is frequently very good in the laboratory with these "clean burners", particularly if the combustion is supported with a catalyst insert. In practice when the fuel charge contains wood logs with different size and reactivity, the result may nevertheless be not so good with unburnt wood residues in the ash layer. The reason for this is that the internal burning support within the fire has been insufficient.

A primary requirement on efficient burning means should be that they shall produce an efficient fire support during the whole burning process particularly in the beginning and at the end of the burning process, when new fuel is put on the fire.

The basket burner constitutes a highly efficient but at the same time surprisingly simple solution of the fire support problem which has been discussed above. The combustion becomes complete and the emissions to the surroundings of the stack gases are small.

The basket burner also exhibits several other important advantages. The lighting is very convenient and rapid. It is not necessary to use paper, birch-bark, fire sticks etc. in the fuel charge. The fire is lighted directly by means of a candle, cigarette lighter etc. Additional charges of fresh fuel is lighted up very rapidly. The fire then takes care of itself.

The delivery of radiation heat from the fire to the surroundings is very good, particularly during the glow phase. The basket burner then exposes a large glowing surface, which is radiating towards the space outside instead of towards the upper parts of the fireplace.

Another advantage is that the basket burner permits a large charge of fuel in a given combustion chamber. This is of value for fireplace inserts, which have to fit into an available limited space. The ash tray can be eliminated thanks to the complete combustion. The basket burner itself keeps the ash.

The most important thing is, however, that the basket burner produces excellent combustion technical and combustion chemical conditions. The fuel charge is lighted completely and is then burning steadily towards the glowing phase or to the instant when a new fuel charge is to be put into the burner.

SUMMARY OF THE INVENTION

The invention is thus concerned with means for generation of radiation heat from a fuel charge comprising a bundle of burning wood logs which assume a near standing but not vertical position characterized in that said means consist of an incline basket shaped like a chute to be placed in an existing fire-place, which means mainly comprise two supporting structures, containing holes for air, which serve as grates, whereby one of these structure the bottom plate, which carries the fuel charge, constitutes the lower end of the basket, whereas the other one, the backing plate, which supports the fuel charge, constitutes the back side of the basket which is shaped as a chute, whereby the angle between the bottom plate and the horizontal plane is less than 45° and the angle between the backing plate and the vertical plane is 5° -20° so that the connection between the bottom plate and the backing plate constitutes the lowest part of the basket.

The appearance of the wood charge on the basket burner may remind of the appearance of the conventional camp-fire. The wood logs on the basket burner are, however, densely packed in parallel which is an important difference. There are, however, other important differences between the appearance of the wood charge on the basket burner and the conventional camp-fire. The basket burner therefore supplies several important functions which are not available with a free wood charge in an open fire-place or with an outdoor fire.

BRIEF DESCRIPTION OF THE DRAWING

The invention shall now be described in more detail by means of the drawing.

FIG. 1 shows in the form of a perspective sketch a basket burner (1) which is charged with a bundle of wood logs (2). The ends of the wood logs in the bundle rest against the bottom plate of the basket burner (3). The bottom plate (3) is in this example a sheet of expanded metal shaped as half circle. The backing plate (4) is in this example shaped as the curved surface of a half cylinder with the same diameter as the bottom plate (3). The angle between the bottom plate (3) and the horizontal plane is typically 25° whereas the angle between the backing plate and the vertical plane is typically 15°, FIG. 2. In this case the angle between the two plates amounts to 80°.

The basket is supported by a structure (5) of iron rods welded together. The supporting structure (5) consists in this case of a back support (6) shaped as semi-circles, supporting legs (7) and a frame construction.

Figure 1:
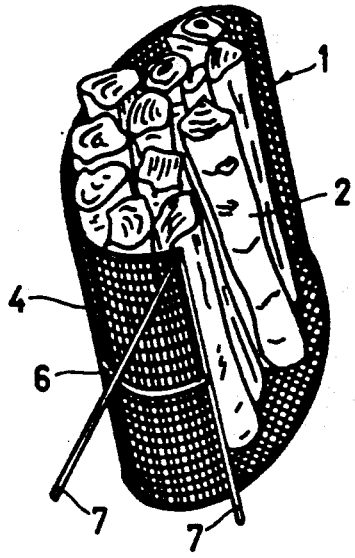
FIG. 1 shows the basket burner with its fuel charge.

The function of the basket burner shall be clarified by means of a description of a complete burning sequence. The basket burner according to FIG. 1 is put up in an open fireplace near the back wall of the fireplace. The basket burner exhibits an advantage already during the first moment, the lighting. The lighting takes place with a candle light placed below the bottom plate (3). After one minute or so the wood immediately above the candle has been lighted. The fire then distributes itself rapidly over the whole bundle of wood logs. The smoke emissions become quite limited thanks to the locally concentrated lighting up and the subsequent rapid overlighting.

The burning is then taking place powerfully but steadily. The air is reaching from all sides including the bottom plate. The minimized ratio between the surface of the wood bundle against the surroundings and its volume prevents, however, a too violent flaming up. The compact packing of the wood logs also contributes to this thanks to the inclination of the bundle of logs compared to a horizontal or vertical wood bed. The inclination also gives a fast and uniform overlighting since the flames from one piece of wood are finding their way to adjacent wood logs.

The fire support function becomes more pronounced towards the end of the burning process. The wood logs move successively towards the central part of the chute of the basket and therefore remain in contact with each other. Some glowing char is falling down towards the glow pocket, which is formed in the lowest part of the basket. The combustion is all the time very efficient since the combustion air is reaching the glow from all sides.

The glowing wood logs rest against the backing plate until they have fallen completely into pieces. This gives an almost vertical bed of glow, which is radiating heat towards the space outside the fireplace.

In this moment one may get very fast lighting up with a new charge of wood. The charge is heated up in the same way as if it had been put on a horizontal bed of glowing char. The upright position and the efficient contact between the combustion air thanks to the basket burner gives a much faster lighting up than on a plane grate.

Towards the end of the burning process remaining glowing char has been collected in the lower part of the basket. When everything is cooled down the ash is still remaining in this part of the burner. The basket burner is removed from the fireplace. The white ash is emptied on a piece of newspaper or in a plastic bag.

The technical action is thus caused by the shape of the basket burner and its orientation. The backing plate is shaped as an inclined chute which keeps together the bundle of wood logs when their volume is reduced during the combustion. The burning wood logs move towards the central part of the chute where they remain upright to near the end of the process. The basket burner provides a maximum of efficient fire support function with the fuel wood in good contact with the combustion air all the time.

DESCRIPTION OF THE PREFERRED EMBODIMENTS

FIGS. 3-7 show different cross sections of the basket burner. The sections are seen from above so that they show different shapes of the bottom plate. The bottom plate may protrude a bit outside the basket section to give extra space for the bundle of wood logs and fall-down during the combustion.

Figures 3, 4, 5, 6, 7:
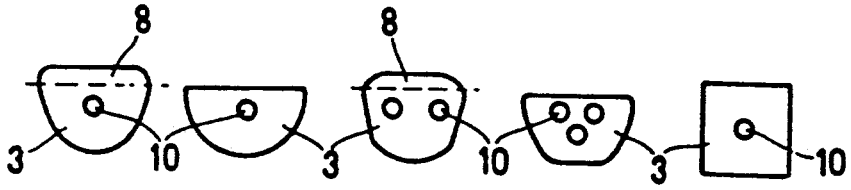
FIGS. 3-7 show different appearances of the supporting structures.

FIG. 3 shows a bow-line for the backing plate similar to the shape of a hanging chain. The logs are to fall in towards the centre of the chute formed by the backing plate. FIGS. 4 and 5 show other bow-lines for the same purpose. FIGS. 6 and 7 show profiles with a flat portion for use when the space available is limited. The logs fall or glide towards the centre also on the flat portion because the burn-off is fastest in the middle of the bundle. FIGS. 3 and 5 show also an forward enlargement of the bottom plate compared to the section of the backing plate.

The bottom plates may be furnished with lighting holes (9) for the lighting flame as shown on FIGS. 3-7.

Figures 8, 9, 10, 11:
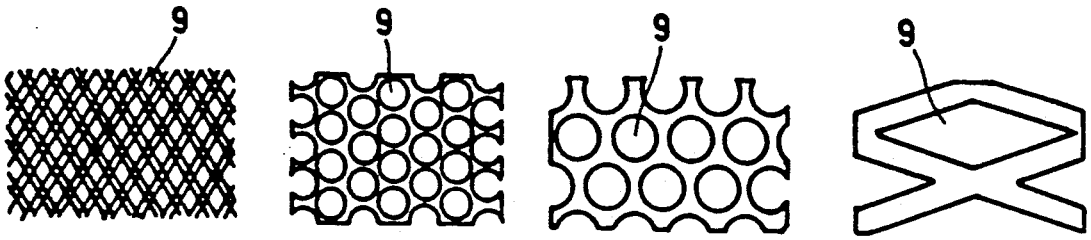
FIGS. 8-11 show different embodiments of these supporting structures.

FIGS. 8-11 show different enbodiments of the plates in natural scale. FIG. 8 shows a plate made in expanded metal with small openings. FIG. 9 shows a similar perforated plate also with small openings. The openings (8) have a largest measure of 1 to 5 mm so as to keep the ash in the basket which thus is serving also as an ash box.

The ash layer may, however, retard the final combustion of the char somewhat. FIGS. 10 and 11 show similar plates but with larger holes so as to permit fine ash to fall out through the walls of the basket, which gives a more rapid final combustion of the glow. In these cases the basket burner can be supplemented with an ash-box below the burner.

The amount of holes in relation to the total surface can be varied within wide limits. As high proportion as possible is desired for the bottom plate, preferrably above 50% so the glow can be seen as well as possible. This is not a desired feature with the backing plate. It is practical to use the same type of holes for the bottom and backing plates. Use of expanded metal according to FIG. 8 is in general quite satisfactory.

The basket burner can be made of carbon steel. One side is always in contact with surrounding air, which prevents overheating which can take place with other designs with the glow on one side of the plate and a burning fuel charge on the other side.

Figure 2:
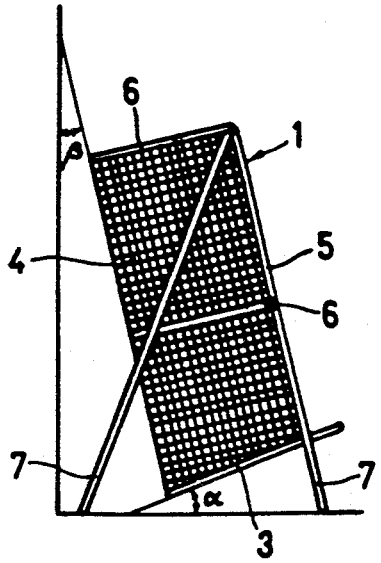
FIG. 2 shows the distinctive features of the burner.

The angles of inclination for the bottom and backing plates are quite important for the technical effect, FIG. 2. The basket should have an angle $\beta$ with the vertical plane which should be below about 45°. A particularly useful value is within the range 5°–20°. The angle $\alpha$ between the bottom plate and the horizontal plane should also be below about 45°. A particularly useful value here is within the range 15°–30°. The angle between the bottom plate and the backing plate is frequently between 60°–90° or somewhat above.

The figures show flat bottom plates and backing plates which have "straight back". It is also possible to use basket shapes with a rounded-appearance of the backing plate respectively "back bow in the backing plate". This gives a certain improvement of the transfer of falling glowing char towards the lowest point of the basket. In practice it is, however, quite satisfactory with the design shown in the figures.

The basket has approximately a constant cross section to make sure that wood logs remain parallel in the bundle of wood. Smaller variations caused by geometrical limitations in the actual fireplace can be tolerated. The variations in the cross section should be below about 10–20% so as to maintain the full function of the basket burner.

EXAMPLE

The technical effects of the invention shall be described with an example. A basket burner made according to the FIGS. 1, 2, 3 and 8 was placed in an open fireplace. The basket burner was designed for fire logs. The backing plate made of expanded metal was 30 cm long. The bottom plate, also made of expanded metal, had a largest width of 30 cm. The angle between the bottom plate and the horizontal plane was 30°, whereas the angle between the backing plate and the vertical plane was 10°. The basket burner was charged with 10 wood logs with about the same size. They were 25 cm long. The fuel was aspen wood with 18% moisture. The weight of the fuel bundle was 1.5 kg.

A few smaller pieces of wood were put in above the lighting hole in the bottom plate. The fire was lighted with a candle placed on a candle plate. It was put under the backing plate. The flame from the candle found its way through the lighting hole towards the small pieces of wood. The charge was lit up rapidly with little of smoke emission Combustion then took place as described above.

The ash was collected when everything had cooled down. Most of it was found in the lowest part of the basket burner. The weight of the ash was 22 g. The ash contained 5 g of small porous pieces of char.

For comparison a similar fuel charge was fired with no basket burner in the same fireplace. The wood logs were put up towards the wall of the fireplace in "pile configuration". Glow and burnt down wood logs were put together during the firing so as to facilitate the final combustion. Under these conditions of "active" burning there was a residue of 120 g containing 100 g unburnt pieces of char. A similar experiment where the fire was burning on its own, "inactive" burning produced a residue of 220 g containing 190 g unburnt pieces of char. In this case two charred wood logs remained standing up against the wall, which were not counted as ash residue.

A large number of comparative experiments according to the above scheme with different kinds of fuels and with variations of the dimensions of the basket burner with different sizes of the holes on the supporting plates etc., always produced the same result. The amount of unburnt char was about 1/10 in the experiment with the basket burner compared to the reference experiment with no basket burner. The delivery of radiation heat to the room was 2–3 times better! The fire support function which is typical for the basket burner also permits combustion with fuel charges containing comparatively large variations between the individual wood logs. If nevertheless a very thick odd wood log would remain in a not complete burnt out condition, when the other wood logs in the burner have been transformed into ash, one has to give this odd wood log a new treatment by means of a new fuel charge.

Addition of new fuel should take place with a simultaneous inlay of several wood logs so as to fill up the basket. If one single wood log is added to a fire, which is almost complete burnt out, the characteristic fuel support function of the basket burner will evidently not be established.

The basket burner according to the invention is useful for all kinds of fireplaces for combustion of wood on a small scale from open fireplaces to wood stoves. One may supplement with other methods like catalyst insert, a special secondary combustion chamber with supply of secondary air, a thermostat for control of the addition of the primary air, pre-heat of the combustion air etc.

The burning means according to the invention can also be used for larger wood boilers with an output of several hundreds of kW. For combustion on this scale the wood bundles have a length of one or a couple of meters. The wood can be charged intermittently on the basket burner by transfer means from a fuel magazine. The wood logs can also be fed in from the side by means of chains. The fuel can comprise timber logs or bundles of thin logs.

The artisan has a considerable freedom for the detailed design of the basket burner within the geometrical contions which are required for the function of the burner.

The above description has for simplicity used the simplest possible shape and design of the supporting plates. The word supporting plate has been choosen for linguistic simplification. The supporting plate has not to be made of steel, it can also be a strong metal wire mesh. Another possibility is to manufacture the supporting plates in cast iron. The holes for air supply can then be parallel with a width of a couple of mm as with a conventional grid.

Basket burners for open fireplaces and for fireplace inserts, where estetic values have importance, can be shaped in different ways. One principle might be that the basket burner shall act but not be seen. It is the fire itself which shall give the value of comfort. This is achieved for instance by making the bottom plate in expanded metal or by means of a strong metal wire mesh, which will expose the bed of glow as a spark screen.

Another possibility is to make the basket burner "beautiful to look on". Some consumers prefer a rustic design which can be obtained by means of cast iron. Other consumers prefer modern design with a supporting structure of steel tubes.

It is of advantage to equip the basket burner with doors on the front to serve as spark screens. These doors are fabricated in the same material as the basket burner and may be furnished with decorative ornamnets, etc.

The most important technical effect with the basket burner is that it gives the maximum possible contribution for the combustion process from the wood charge itself to produce the best possible result from an environmental point of view. The reduction of unburnt material to a negligible level gives also an important improvement of the efficiency, frequently with about 10-20%. The increase of the radiation heat to the room from the wide flame from the fully burning fire as well as from the glow bed when the basket burner is used in an open fireplace gives a better delivery of heat to the room-not only an increase of the comfort value. If one would like to improve the delivery of heat further in this particular embodiment one might also furnish the basket burner with steel tubes, which take cool air from the room at the opening below of the fireplace and then deliver warm air back to the room by means of nozzles at the upper edge of the opening of the fireplace. The shape of the basket burner is quite useful for such a warm air supplement.

These final comments show the different possibilities which are available for the designer to make use of the properties of the new burner. Thanks to the improvement of the combustion from an environmental point of view the basket burner can contribute to increased wood burning also in densely populated areas.

What I claim is:

1. Means for generation of radiation heat from a fuel charge comprising a bundle (2) of burning wood logs which assumes a near standing but not vertical position characterized in that said means consist of an inclined basket (1) shaped like a chute to be placed in an existing fire-place, which means mainly comprise two supporting structures, containing holes (8) for air, which serve as grates, whereby one of these structures, the bottom plate (3) which carries the fuel charge, constitutes the lower end of the basket, whereas the other one, the backing plate (4) which supports the fuel charge, constitutes the back side of the basket which is shaped as a chute, whereby the angle between the bottom plate (3) and the horizontal plane is less than 45° and the angle between the backing plate (4) and the vertical plane is 5°-20° so that the connection between the bottom plate and the backing plate constitutes the lowest part of the basket (1).

2. Means according to claim 1 characterized in that the horizontal cross-section through the plate (4) has the shape of a plurality of freely hanging chains.

3. Means according to claim 1 characterized in that the horizontal cross-section through the plate (4) has the shape of a semi-circle.

4. Means according to claim 1 characterized in that the bottom plate (3) and the backing plate (4) are made of an expanded metal sheet with openings 1-5 mm.

5. Means according to claim 1 characterized in that one or several holes (9) are disposed in the bottom plate (3).

6. Means for generation of radiation heat from a fuel charge comprising a bundle (2) of burning wood logs which assumes a near standing but not vertical position characterized in that said means consist of an inclined basket (1) shaped like a chute to be placed in an existing fire-place, which means mainly comprise two supporting structures, containing holes (8) for air, which serve as grates, whereby one of these structures, the bottom plate (3) which carries the fuel charge, constitutes the lower end of the basket, whereas the other one, the backing plate (4) which supports the fuel charge, constitutes the back side of the basket which is shaped as a chute, whereby the angle between the bottom plate (3) and the horizontal plane is less than 45° and the angle between the backing plate (4) and the vertical plane is 5°-20° so that the connection between the bottom plate and the backing plate constitutes the lowest part of the basket (1), said means being furnished with doors for spark protection.

* * * * *